United States Patent [19]

Mitsuo et al.

[11] Patent Number: 4,601,920

[45] Date of Patent: Jul. 22, 1986

[54] PROCESS FOR THE PREPARATION OF COLOR DEVELOPER SHEETS FOR PRESSURE-SENSITIVE RECORDING

[75] Inventors: Hirofumi Mitsuo; Keiso Saeki, both of Shizuoka, Japan

[73] Assignee: Fuji Photo Film Co., Ltd., Kanagawa, Japan

[21] Appl. No.: 582,500

[22] Filed: Feb. 22, 1984

[30] Foreign Application Priority Data

Feb. 22, 1983 [JP] Japan ..... 58-29114

[51] Int. Cl.[4] ..... B41M 5/22

[52] U.S. Cl. ..... 427/150; 346/207; 346/210; 346/211; 346/212; 346/213; 346/216

[58] Field of Search ..... 346/200, 213, 226, 207, 346/210–212, 216, 225; 427/150, 151, 152

[56] References Cited

FOREIGN PATENT DOCUMENTS 0143322 8/1979 Japan ..... 427/150

*Primary Examiner*—Bruce H. Hess

*Attorney, Agent, or Firm*—Sughrue, Mion, Zinn, Macpeak & Seas

[57] ABSTRACT

A process for preparing a color developer sheet for pressure-sensitive recording is disclosed. The sheet is comprised of a coating solution on a support, said coating solution being prepared by dissolving an aromatic carboxylic acid metal salt in an organic solvent and then emulsifying the resulting solution in water. The organic solvent is such that the viscosity of a 50% by weight solution of the aromatic carboxylic acid metal salt in the organic solvent falls within the range of from 200 to 4,000 centipoises. This color developer sheet shows a high color-forming rate and its coated surface is free of irregularity and includes a consistent amount of coating material.

20 Claims, No Drawings

PROCESS FOR THE PREPARATION OF COLOR DEVELOPER SHEETS FOR PRESSURE-SENSITIVE RECORDING

FIELD OF THE INVENTION

The present invention relates to a process for the preparation of color developer sheets for use in pressure-sensitive recording. More particularly, the present invention relates to a process for preparing color developer sheets for pressure-sensitive recording by coating or incorporating a colorless color former and a color developer on a support base. The color developer becomes an adsorbing or reactive compound which forms a color on contact with the color former.

BACKGROUND OF THE INVENTION

Pressure-sensitive recording materials utilizing the color-forming reaction of a color former (a substance forming color on donating an electron or on accepting a proton, such as an acid) and a color developer (a substance accepting an electron or donating a proton, such as clay substances, e.g., acid clay, activated clay, attapulgite, zeolite, bentonite, and kaolin, aromatic carboxylic acid metal salts, and a phenol-formaldehyde resin) are well known, as described in, for example, U.S. Pat. Nos. 2,505,470, 2,505,489, 2,550,471, 2,548,366, 2,712,507, 2,730,456, 2,730,457, 3,418,250, Japanese Patent Publication (unexamined) Nos. 28411/74 and 44009/75.

In addition, printing methods for forming a colored image by applying an ink containing a color former onto a sheet with a color developer coated thereon are known (see German Patent Application (OLS) No. 1,939,962).

As described above, various color developers are known to be used in the preparation of pressure-sensitive recording materials.

When, however, clays such as activated clay and acid clay, which are widely used as a color developer at present, are used, the final color-forming member suffers from various disadvantages; for example, light resistance and water resistance are poor, and storage stability is also poor.

It is known that aromatic carboxylic acid metal salts are free from the problems as described above.

Color developer sheets using such aromatic carboxylic acid metal salts are generally prepared by mechanically dispersing a mixture of the color developers, inorganic pigments, binders, dispersants, and other additives in water to prepare a coating solution and coating the coating solution on a support.

Japanese Patent Publication (unexamined) No. 143322/79 discloses a method of forming a color developer sheet in which the color developer is dissolved in an organic solvent and emulsified in water to prepare a coating solution, and the coating solution thus prepared is coated on a support. A pressure-sensitive recording sheet utilizing the color developer sheet as prepared by the foregoing method has the advantage that the color developer reacts efficiently with the color former; therefore, the sheet exhibits superior color-forming properties even by using a small amount of color developer. It has been revealed, however, that the pressure-sensitive recording sheet suffers from the serious disadvantage that the coated surface is uneven or has irregularities, which is due to the very poor stability of the emulsion. Furthermore, the color-forming rate of the sheet is not always sufficiently satisfactory. Hence, it has been desired to overcome these problems.

SUMMARY OF THE INVENTION

An object of the invention is to improve the stability of an emulsion and to provide a color developer sheet for pressure-sensitive recording in which the coated surface is free of irregularity and includes a consistent amount of coating material.

Another object of the invention is to provide a color developer sheet for pressure-sensitive recording, which shows a high color-forming rate.

It has been found that the objects can be attained by using specific organic solvents in the preparation of emulsions of aromatic carboxylic acid metal salts.

The present invention relates to a process for preparing a color developer sheet for pressure-sensitive recording by coating a coating solution on a support, said coating solution being prepared by dissolving an aromatic carboxylic acid metal salt in an organic solvent and then emulsifying the resulting solution in water. The organic solvent is such that the viscosity (35° C.) of a 50% by weight solution of the aromatic carboxylic acid metal salt as color developer in the organic solvent ranges between 200 and 4,000 centipoises (cp).

DETAILED DESCRIPTION OF THE INVENTION

If there are used organic solvents which produce a 50% by weight solution having a viscosity (35° C.) of less than 200 centipoises or more than 4,000 centipoises, the stability of the resulting emulsion will be poor, the coated surface will include irregularities, the amount of the coating will not be consistent and the color-forming rate will not be sufficiently high.

The organic solvents as used herein are such that a 50% by weight solution of the aromatic carboxylic acid metal salt at 35° C. is from 200 to 4,000 centipoises, preferably from 400 to 2,500 centipoises, and most preferably from 600 to 1,700 centipoises. Typical examples of the organic solvents include 1-isopropylphenyl-2-phenylethane, 1-isopropylphenyl-1-phenylethane, 1,1-ditolylethane, and 1-ethylphenyl--phenylethane, although the present invention is not intended to be limited thereto. Preferred examples of the organic solvent also suitable for use in the present invention are diphenylalkane derivatives as described in U.S. Pat. No. 3,836,383 or British Pat. No. 1,346,364. In combination with these organic solvents, solvents having poor dissolving abilities such as a petroleum fraction having a boiling point range of 150° to 310° C. can be used as diluents.

Useful metal salts of aromatic carboxylic acids are described in, for example, U.S. Pat. Nos. 3,864,146 and 3,983,292 and British patent application No. 2,017,090.

Typical examples of such aromatic carboxylic acids include benzoic acid, o-, m- or p-chlorobenzoic acid, o-, m- or p-nitrobenzoic acid, o-, m- or p-toluic acid, 4-methyl-3-nitrobenzoic acid, 2-chloro-4-nitrobenzoic acid, 2,3-dichlorobenzoic acid, 2,4-dichlorobenzoic acid, p-isopropylbenzoic acid, 2,5-dinitrobenzoic acid, p-tert-butylbenzoic acid, N-phenylanthranilic acid, 4-methyl-3-nitrobenzoic acid, salicylic acid, m-hydroxybenzoic acid, p-hydroxybenzoic acid, 3,5-dinitrosalicylic acid, 5-tert-butylsalicylic acid, 3-phenylsalicylic acid, 3-methyl-5-tert-butylsalicylic acid, 3,5-di-tert-butylsalicylic acid, 3,5-di-tert-amylsalicylic acid, 3-cyclohexylsalicylic acid, 5-cyclohexylsalicylic acid, 3-cyclohexyl-5-(α,α-dimethylbenzyl)salicylic acid, 3-methyl-5-isoamylsalicylic acid, 5-isoamylsalicylic acid, 3,5-di-sec-butylsalicylic acid, 5-nonylsalicylic acid, 3,5-di-tert-octylsalicylic acid, 2-hydroxy-3-methylbenzoic acid, 2-hydroxy-5-tert-butylbenzoic acid, 2,4-cresotinic acid, 5,5-methylenedisalicylic acid, o-, m- or p-acetaminobenzoic acid, 2,4-dihydroxybenzoic acid, 2,5-dihydroxybenzoic acid, anacardic acid, 1-naphthoenic acid, 3,5-di-α,α-dimethylbenzylsalicylic acid, 3,5-di-α-methylbenzylsalicylic acid, 3-(α-methylbenzyl)-5-(α,α-dimethylbenzyl)salicylic acid, 2-naphthoenic acid, 1-hydroxy-2-naphthoenic acid, 2-hydroxy-3-naphthoenic acid, 2-hydroxy-1-naphthoenic acid, thiosalicylic acid, 2-carboxybenzaldehyde, and the like. It is preferred to have hydroxy groups in the positions ortho or para to one or more carboxyl groups in the above-described metal salts of aromatic carboxylic acids. Of such aromatic carboxylic acids, salicylic acid derivatives are preferred and, further, those which have substituent groups containing 8 or more carbon atoms, such as alkyl, aryl or aralkyl in at least either the o- or p-position(s) to the one or more hydroxy groups and acids wherein such substituents contain 8 or more carbon atoms in total are particularly preferred. Examples of particularly preferred aromatic carboxylic acids include 3,5-di-t-butylsalicylic acid, 3,5-di-t-amylsalicylic acid, 3,5-di-α,α-dimethylbenzylsalicylic acid, 3,5-di-α-methylbenzylsalicylic acid, 3-(α-methylbenzyl)-5-(α,α-dimethylbenzyl)salicylic acid, 3,5-di-t-octylsalicylic acid and 3-cyclohexyl-5-(α,α-dimethylbenzyl)salicylic acid.

Metals whose ions are reacted with the above-described aromatic carboxylic acids to produce the corresponding salts include magnesium, aluminum, calcium, titanium, manganese, iron, cobalt, nickel, copper, zinc, cadmium, tin, antimony and barium. Of these metals, especially effective are zinc, tin and aluminum and the most effective metal is zinc among such metals.

These aromatic carboxylic acid metal salt color developers can be used singly or in combination with each other.

The color developer is dissolved in the organic solvent so that the concentration is from 5 to 70% by weight and preferably from 20 to 55% by weight. The thus-prepared organic solvent solution is then emulsified in water by means of, e.g., a stirrer to prepare the desired coating solution.

The amount of the organic solvent solution being used is from about 5 to about 120% by weight and preferably from 50 to about 100% by weight based on the weight of the water. In this case, the addition of ionic or nonionic surface active agents, or water-soluble polymers produces the advantage that a stable emulsion can be prepared in a short period of time. Suitable examples of such ionic or nonionic surface active agents include an anionic surface active agent such as alkylbenzenesulfonate, e.g., triethanolamine salt of dodecylbenzenesulfonic acid, a nonionic surface active agent such as fatty acid ester of polyoxyethylene sorbitan, e.g., oleic acid ester of polyoxyethylene sorbitan, etc.

The emulsification is usually carried out by means of dissolver. The suitable particle size of the emulsion is preferably about 1 to 5 microns, more preferably 1 to 3 microns.

The addition of inorganic pigments such as titanium oxide, zinc oxide, silicon oxide, calcium oxide, calcium carbonate, aluminum hydroxide, kaolin, talc, barium sulfate, and activated clay in combination in the preparation of the coating solution produces various desirable effects; for example, the coating suitability, shielding force, and developing ability are increased. Preferred examples of such inorganic pigments are calcium carbonate, aluminum hydroxide, kaolin or activated clay. Furthermore, when such inorganic pigments are dispersed by means of a media dispersing machine such as a sand mill, a ball mill and an attritor, the developing ability is further increased and other desirable effects such as an increase in the quality of the coated surface can be obtained. The amount of the inorganic pigment added is from 1 to 1,000 parts by weight per part of the color developer, preferably from 2 to 50 parts by weight.

The thus-prepared coating solution is coated on a support after being mixed with a binder.

Binders which can be used are synthetic or natural polymeric substances generally known in the art, such as latexes, e.g., a styrene/butadiene copolymer latex, polyvinyl alcohol, a maleic anhydride/styrene copolymer, starch, casein, gum arabic, gelatin, carboxymethyl cellulose and methyl cellulose. Preferred examples of such binders are styrene-butadiene copolymer, polyvinyl alcohol and starch. The amount of the binder to be used is preferably from about 3 to 20% by weight based on the weight of the total solid components, more preferably from 5 to 15% by weight.

The final amount of the color developer coated on the support is from about 0.1 to 3.0 g/m$^2$ and preferably from 0.2 to 1.0 g/m$^2$.

There is no special limitation on the color former to be reacted with the color developer sheet of the invention. Examples of such color former which undergo coloration reactions together with the color developer sheet include triallylmethane-based compounds, diphenylmethane-based compounds, xanthene-based compounds, thiazine-based compounds, and spiropyran-based compounds.

Typical examples of color formers are as follows:

(1) Triarylmethane-based compounds, such as 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis-(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, and 3-p-dimethylaminophenyl-3-(1-methylpyrrol-2-yl)-6-dimethylaminophthalide;

(2) Diphenylmethane-based compounds, such as 4,4'-bisdimethylaminobenzhydrin benzyl ether, N-halophenyl leucoauramine and N-2,4,5-trichlorophenyl leucoauramine;

(3) Xanthene-based compounds, such as Rhodamine B-anilinolactam, Rhodamine B-p-nitroanilinolactam, Rhodamine B-p-chloroanilinolactam, 2-dimethylamino-7-methoxyfluoran, 3-diethylamino-7-methoxyfluoran, 3-diethylamino-7-chlorofluoran, 2-diethylamino-3-chloro-7-methylfluoran, 7-diethylamino-2,2-dimethylfluoran, 7-diethylamino-3-acetylmethylaminofluoran, 7-diethylamino-3'-methylaminofluoran, 3-diethylamino-6-methyl-7-anilinofluoran, 3,7-diethylaminofluoran, 3-diethylamino-7-dibenzylaminofluoran, 3-diethylamino-7-methylbenzylaminofluoran, 3-diethylamino-7-chloroethylmethylaminofluoran, and 3-diethylamino-7-diethylaminofluoran;

(4) Thiazine-based compounds, such as benzoyl leuco Methylene Blue, and p-nitrobenzoyl leuco Methylene Blue; and (5) Spiro-based compounds, such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)-spiropyran, and 3-propyl-spiro-dibenzopyran.

These compounds may be used alone or in combination with each other.

The color former is dissolved in a solvent, encapsulated, and coated on a support by the usual method.

As solvents, natural or synthetic oils can be used singly or in combination with each other. Examples of such solvents include cotton seed oil, kerosene, paraffin, naphthene oil, alkylated biphenyl, alkylated terphenyl, alkylated naphthalene, diarylethane, triarylmethane and chlorinated paraffin.

Color former-containing microcapsules can be prepared by techniques such as the interfacial polymerization method as described in British Pat. Nos. 867,797, 950,443, 989,264, 1,091,076 and 2,062,570 and U.S. Pat. No. 4,409,156, the internal polymerization method, the phase separation method, the external polymerization method, and the coacervation method as described in U.S. Pat. Nos. 2,800,457 and 2,800,458. Water-soluble binders, latex binders, cellulose powder, starch particles, talc, and so forth are added to obtain a color former-containing microcapsule coating solution.

The color developer sheet for pressure-sensitive recording of the invention was tested for performance using a color former-containing microcapsule sheet as described below. Unless otherwise indicated in the following examples, all parts and percents are by weight.

Preparation of Color Former-Containing Microcapsule Sheet

A partial sodiium salt of polyvinylbenzenesulfonic acid (VERSA TL 500, produced by National Starch Co., Ltd.; average molecular weight: 500,000) (5 parts) was added to and dissolved in 95 parts of hot water maintained at about 80° C. while stirring over about 30 minutes. At the end of the time, the resulting aqueous solution was cooled. The pH of the aqueous solution was 2 to 3, and it was adjusted to 4.0 by adding a 20% by weight aqueous solution of sodium hydroxide.

Separately 100 parts of diisopropylnaphthalene containing 2.5% of Crystal Violet Lactone and 1.0% of Benzoyl Leuco Methylene Blue was emulsified and dispersed in 100 parts of a 5% aqueous solution of the same polyvinylbenzenesulfonic acid partial sodium salt as used above to prepare an emulsion having a grain size (a mean grain diameter) of 4.5 $\mu$.

A mixture of 6 parts of melamine, 11 parts of a 37% by weight aqueous formaldehyde solution, and 30 parts of water was heated to 60° C. and stirred at that temperature. After 30 minutes, a transparent mixed aqueous solution of melamine, formaldehyde, and a melamine/formaldehyde initial condensate was obtained. The pH of the mixed aqueous solution was 6 to 8. This aqueous solution is hereinafter referred to as an "initial condensate solution".

The initial condensate solution was added to and mixed with the emulsion as prepared above, and the resulting mixture was then adjusted to pH 6.0 by adding a 3.6% by weight hydrochloric acid solution while stirring, raised in temperature to 65° C., and stirred for 360 minutes. The thus-prepared capsule solution was cooled to room temperature and adjusted to pH 9.0 by adding 20% by weight sodium hydroxide.

To the capsule solution were added 200 parts of a 10% by weight aqueous solution of polyvinyl alcohol and 50 parts of starch particles, and the solids content of the resulting mixture was adjusted to 20% by adding water to prepare a color former-containing microcapsule coating solution.

This coating solution was coated on a paper support of 50 g/m$^2$ by means of an air knife coater in such an amount that the amount of the solids coated was 5 g/m$^2$ and then dried to prepare the desired color former-containing capsule sheet.

The present invention is described in greater detail with reference to the following examples and comparative examples.

EXAMPLE 1

10 parts of zinc, 3,5-di-$\alpha$-methylbenzylsalicylate was added to 10 parts of 1-ethylphenyl-1-phenylethane, dissolved therein by heating at 90° C., and then cooled to 35° C. The viscosity of the solution as prepared above was 700 centipoises. This solution was added to 50 parts of a 2% aqueous solution of polyvinyl alcohol (PVA-205, produced by Kuraray Co., Ltd.), and additionally 0.1 part of a 10% aqueous solution of sodium sulfosuccinate was added as a surface active agent. The resulting mixture was stirred for 15 minutes by means of a homogenizer to prepare an emulsion.

A mixture of 80 parts of calcium carbonate, 20 parts of zinc oxide, and 1 part of sodium hexametaphosphate was dispersed in 200 parts of water by means of a Kedy mill. The resulting mixture was further subjected to a sand mill treatment to prepare a dispersion. This dispersion was mixed with the emulsion as prepared above. In addition, as binders, 100 parts of a 10% aqueous solution of PVA-110 (produced by Kuraray Co., Ltd.) and 10 parts (as solids) of a carboxy-modified SBR latex (SN-304, produced by Sumitomo Nougatax Co., Ltd.) were added, and water was then added to adjust the solids content to 20%.

The thus-prepared coating solution was coated on a paper support of 50 g/m$^2$ by means of an air knife coater in such an amount that the amount of the solids coated was 5.5 g/m$^2$, and then dried to prepare a color developer sheet.

EXAMPLE 2

A color developer sheet was prepared in the same manner as in Example 1 except that 1-isopropylphenyl-2-phenylethane (the viscosity of the solution was 1,080 centipoises) was used in place of 1-ethylphenyl-1-phenylethane.

EXAMPLE 3

A color developer sheet was prepared in the same manner as in Example 1 except that 1-isopropylphenyl-1-phenylethane (the viscosity of the solution was 1,850 centipoises) was used in place of 1-ethylphenyl-1-phenylethane.

EXAMPLE 4

A color developer sheet was prepared in the same manner as in Example 1 except that 6 parts of 1-isopropylphenyl-2-phenylethane and 4 parts of isoparaffin as a diluent (the viscosity of the solution was 850 centipoises) were used in place of 10 parts of 1-ethylphenyl-1-phenylethane.

COMPARATIVE EXAMPLE 1

A color developer sheet was prepared in the same manner as in Example 1 except that diisopropylnaphthalene (the viscosity of the solution was 6,300 centipoises) was used in place of 1-ethylphenyl-1-phenylethane.

COMPARATIVE EXAMPLE 2

A color developer sheet was prepared in the same manner as in Example 1 except that isobutyl acetate (the viscosity of the solution was 120 centipoises) was used in place of 1-ethylphenyl-1-phenylethane.

The color developer sheets as prepared in the Examples and Comparative Examples were compared in the following respects:

(1) State of Coated Surface

A 1.0% toluene solution of Crystal Violet Lactone was applied to each color developer sheet to cause its entire surface to form color. The state of unevenness in the color formation was observed with the eye.

(2) Color-Forming Rate

The color former-containing microcapsule sheet was placed on each color developer sheet and a load of 600 kg/cm$^2$ was applied to cause color-formation. The intensity of the thus-colored material at a wavelength of 610 nm was measured by the use of a Hitachi color analyzer Model 307 type 15 seconds after the color formation and also one day after the color formation. The color-forming rate was calculated by the following equation:

$$\text{Color-Forming Rate} = \frac{\text{Intensity after 15 seconds}}{\text{Intensity after one day}}$$

The results are shown in Table 1.

TABLE 1

| Run No. | State of Coated Surface* | Color-Forming Rate |
|---|---|---|
| Example 1 | A | 0.90 |
| Example 2 | A | 0.91 |
| Example 3 | B | 0.89 |
| Example 4 | A | 0.91 |
| Comparative Example 1 | C | 0.80 |
| Comparative Example 2 | C | 0.78 |

Note
*The rating for the state of the coated surface was defined as follows:
A: No unevenness in color formation
B: Unevenness in color formation is formed, but to the extent that no problem arises for practical use.
C: Unevenness in color formation is formed unsuitably for practical use.

As can be seen from the results in Table 1, the color developer sheets of the invention are satisfactory in both the respects: the state of the coated surface and the color-forming rate.

While the invention has been described in detail and with reference to specific embodiments thereof, it will be apparent to one skilled in the art that various changes and modifications can be made therein without departing from the spirit and scope thereof.

What is claimed is:

1. A process for preparing a color developer sheet for pressure-sensitive recording, comprising the steps of:

dissolving an aromatic carboxylic acid metal salt in an organic solvent, wherein the organic solvent is such that the viscosity of a 50% by weight solution of the aromatic carboxylic acid metal salt in the organic solvent at 35° C. ranges between 200 and 4,000 centipoises;

emulsifying the resulting solution in water to prepare a coating solution; and coating the resulting coating solution on a support base.

2. A process for preparing a color developer sheet for pressure-sensitive recording as claimed in claim 1, wherein the organic solvent is such that a 50% by weight solution of the aromatic carboxylic acid metal salt at 35° C. has a viscosity ranging between 400 and 2,500 centipoises.

3. A process for preparing a color developer sheet for pressure-sensitive recording as claimed in claim 2, wherein the organic solvent is such that a 50% by weight solution of the aromatic carboxylic acid metal salt at 35° C. has a viscosity ranging between 600 to 1,700 centipoises.

4. A process for preparing a color developer sheet for pressure-sensitive recording as claimed in claim 1, wherein the aromatic carboxylic acid metal salt is dissolved in the organic solvent in an amount in the range of 5 to 70% by weight.

5. A process for preparing a color developer sheet for pressure-sensitive recording as claimed in claim 4, wherein the aromatic carboxylic acid metal salt is dissolved in the organic solvent in an amount in the range of 20 to 55% by weight.

6. A process for preparing a color developer sheet for pressure-sensitive recording as claimed in claim 1, wherein the organic solvent solution is present in an amount in the range of about 5 to 120% by weight based on the weight of the water.

7. A process for preparing a color developer sheet for pressure-sensitive recording as claimed in claim 6, wherein the organic solvent solution is present in an amount in the range of 50 to 100% by weight based on the weight of the water.

8. A process for preparing a color developer sheet for pressure-sensitive recording as claimed in claim 1, wherein the coating solution is further comprised of an inorganic pigment present in the amount in the range of 1 to 1,000 parts by weight based on the weight of the color developer.

9. A process for preparing a color developer sheet for pressure-sensitive recording as claimed in claim 8, wherein the inorganic pigment is present in an amount in the range of 2 to 50 parts by weight based on the weight of the color developer.

10. A process for preparing a color developer sheet for pressure-sensitive recording as claimed in claim 1, wherein the aromatic carboxylic acid metal salts are present on the support base in an amount in the range of 0.1 to 3.0 g/m$^2$.

11. A process for preparing a color developer sheet for pressure-sensitive recording as claimed in claim 10, wherein the aromatic carboxylic acid metal salts are present on the support base in an amount in the range of 0.2 to 1.0 g/m$^2$.

12. A process for preparing a color developer sheet for pressure-sensitive recording as claimed in claim 1, wherein said organic solvent is selected from the group consisting of 1-isopropylphenyl-2-phenylethane, 1-isopropylphenyl-1-phenylethane, 1, 1-ditolylethane and 1-ethylphenyl-1-phenylethane.

13. A process for preparing a color developer sheet for pressure-sensitive recording as claimed in claim 1, wherein said organic solvent is a diphenylalkane.

14. A process for preparing a color-developer sheet for pressure-sensitive recording as claimed in claim 1, wherein said aromatic carboxylic acid metal salt is a metal salt of an aromatic carboxylic acid selected from the group consisting of benzoic acid, o-, m- or p- chlorobenzoic acid, o-, m- or p-nitrobenzoic acid, o-, m- or p-toluic acid, 4-methyl-3-nitrobenzoic acid, 2-chloro-4-nitrobenzoic acid, 2,3-dichlorobenzoic acid, 2,4-dichlorobenzoic acid p-isopropylbenzoic acid, 2,5-dinitrobenzoic acid, p-tert-butylbenzoic acid, N-phenylanthranilic acid, 4-methyl-3-nitrobenzoic acid, salicylic acid, m-hydroxy-benzoic acid, p-hydroxybenzoic acid, 3,5-dinitrosalicyclic acid, 5-tert-butylsalicylic acid, 3-phenylsalicylic acid, 3-methyl-5-tert-butylsalicylic acid, 3,5-di-tert-amylsalicylic acid, 3-cyclohexylsalicylic acid, 5-cyclohexylsalicylic acid, 3-cyclohexyl-5-(α,α-dimethylbenzyl)salicylic acid, 3-methyl-5-isoamyl-salicylic acid, 5-isoamylsalicylic acid, 3,5-disecbutylsalicylic acid, 5-nonylsalicylic acid, 3,5-di-tert-octylsalicylic acid, 2-hydroxy-3-methylbenzoic acid, 2-hydroxy-5-tert-butylbenzoic acid, 2,4-cresotinic acid, 5,5-methylenedisalicylic acid, o-, m- or p-acetaminobenzoic acid, 2,4-dihydroxybenzoic acid, 2,5-dihydroxybenzoic acid, anacardic acid, 1-naphthoenic acid, 3,5-di-α,α-dimethylbenzylsalicylic acid, 3,5-di-α-methylbenzylsalicylic acid, 3-(α-methylbenzyl)-5-(α,α-dimethylbenzyl) salicylic acid, 2-naphthoenic acid, 1-hydroxy-2-naphthoenic acid, 2-hydroxy-3-naphthoenic acid, 2-hydroxy-1-naphthoenic acid, thiosalicylic acid and 2-carboxybenzaldehyde.

15. A process for preparing a color developer sheet for pressure-sensitive recording as claimed in claim 14, wherein said aromatic carboxycylic acid is a metal salt of an aromatic carboxylic acid selected from the group comprising salicylic acid derivatives.

16. A process for preparing a color developer sheet for pressure-sensitive recording as claimed in claim 14, wherein said aromatic carboxylic acid metal salt is obtained through a reaction of an aromatic carboxylic acid and a metal ion selected from the group of ions of magnesium, aluminum, calcium, titanium, manganese, iron, cobalt, nickel, copper zinc, cadmium, tin, antimony and barium.

17. A process for preparing a color developer sheet for pressure-sensitive recording as claimed in claim 16, wherein said metal ion is selected from the group consisting of ions of zinc, tin and aluminum.

18. A process for preparing a color developer sheet for pressure-sensitive recording as claimed in claim 17, wherein said metal ion is an ion of zinc.

19. A process for preparing a color developer sheet for pressure-sensitive recording as claimed in claim 1, wherein said aromatic carboxyclic acid metal salt is a metal salt of an aromatic carboxylic acid selected from the group consisting of 3,5-di-t-butyl-salicylic acid, 3,5-di-t-amylsalicylic acid, 3,5-di-α,α-dimethylbenzylsalicylic acid, 3,5-di-α-methylbenzylsalicylic acid, 3-(α-methylbenzyl)-5-(α,α-dimethylbenzyl)-salicylic acid, 3,5-di-t-octylsalicylic acid and 3-cyclohexyl-5-(α,α-dimethylbenzyl) salicylic acid.

20. A process for preparing a color developer sheet for pressure-sensitive recording as claimed in claim 1, wherein the coating solution is further comprised of an inorganic pigment selected from the group consisting of titanium oxide, zinc oxide, silicon oxide, calcium oxide, calcium carbonate, aluminum hydroxide, kaolin, talc, barium sulfate and activated clay.

* * * * *